US011171403B1

(12) United States Patent
Huang et al.

(10) Patent No.: US 11,171,403 B1
(45) Date of Patent: Nov. 9, 2021

(54) AUTO ORIENTATING ANTENNA DEVICE

(71) Applicant: Tatung Technology Inc., Taipei (TW)

(72) Inventors: Chi-Lung Huang, Taipei (TW); Bing-Sheng Chen, Taipei (TW)

(73) Assignee: TATUNG TECHNOLOGY INC., Taipei (TW)

( * ) Notice: Subject to any disclaimer, the term of this patent is extended or adjusted under 35 U.S.C. 154(b) by 0 days.

(21) Appl. No.: 16/869,625

(22) Filed: May 8, 2020

(51) Int. Cl.
*H01Q 1/12* (2006.01)
*H01Q 3/06* (2006.01)

(52) U.S. Cl.
CPC ..... *H01Q 1/1257* (2013.01); *H01Q 3/06* (2013.01)

(58) Field of Classification Search
CPC ..... H01Q 1/1257; H01Q 3/06
See application file for complete search history.

(56) References Cited

U.S. PATENT DOCUMENTS 3,671,969 A * 6/1972 Basman ..... H01Q 3/005 342/426
6,278,405 B1 * 8/2001 Ha ..... G01S 3/38 342/359
7,162,273 B1 * 1/2007 Abramov ..... H01Q 3/04 342/383
2008/0248798 A1 * 10/2008 Chung ..... H01Q 1/2291 455/425
2013/0321225 A1 * 12/2013 Pettus ..... H01Q 1/18 343/765
2015/0070222 A1 * 3/2015 Kang ..... H01Q 21/28 343/702
2016/0359224 A1 * 12/2016 Mellor ..... H01Q 3/08
2021/0050660 A1 * 2/2021 Anderson ..... H01Q 1/1257
2021/0050664 A1 * 2/2021 Lin ..... H01Q 21/065

* cited by examiner

*Primary Examiner* — Ab Salam Alkassim, Jr.
(74) *Attorney, Agent, or Firm* — Bacon & Thomas, PLLC

(57) ABSTRACT

An auto orientating antenna device includes a base, a body and a processing chip. The base includes a motor comprising a rotating shaft. The body is connected to the rotating shaft and comprises at least one 5G antenna. The processing chip generates an auto orientating instruction according to at least one signal receiving status of the antenna unit. The motor drives the rotating shaft according to the auto orientating instruction, so as to let the antenna unit face a receiving direction.

8 Claims, 8 Drawing Sheets

AUTO ORIENTATING ANTENNA DEVICE

BACKGROUND OF THE INVENTION

1. Field of the Invention

The present disclosure relates to an antenna device, and, more particularly, to an auto orientating antenna device.

2. Description of Related Art

With the development of technology, 5G (5th generation mobile network) has become a main technology of wireless communication, and various 5G antenna devices, such as routers and sharers, have also been manufactured. Since 5G antenna units need to operate in an ultra-high frequency band, such as 24 GHz, the size of the 5G antenna units need to be smaller than that of the prior arts (such as 4G antenna units), and thus 5G antenna units are more sensitive to the environmental interference. Therefore, the 5G antenna, units need to be orientated to face a correct receiving direction.

However, since an antenna device needs to be connected to a power supply, the arrangement of the antenna device may be limited to the location of the power supply outlet in the house, and thus it may be difficult for a user to arrange the antenna device to face the correct receiving direction corresponding to enough signal strength. A good signal transmission cannot be realized without the correct receiving direction.

Therefore, it is desirable to provide an improved antenna device to mitigate and/or obviate the aforementioned problems.

SUMMARY OF THE INVENTION

The object of the present disclosure is to provide an auto orientating antenna device capable of automatically facing a suitable receiving direction.

To achieve the object, the auto orientating antenna device of the present disclosure comprises a base, a body, and a processing chip. The base comprises a motor comprising a rotating shaft. The body is connected to the rotating shaft, and the body comprises at least one 5G (5th generation mobile network) antenna unit. The processing chip generates an auto orientating instruction according to at least one signal receiving status of the antenna unit, wherein the motor drives the rotating shaft according to the auto orientating instruction, so as to let the antenna unit face a receiving direction. Thus, the auto orientating antenna device can rotate automatically to face a suitable receiving direction according the signal receiving status.

In an embodiment, the body of the auto orientating antenna device comprises an inner case having an inner case side part, and the inner case side part has a plurality of holes formed thereon.

Furthermore, the auto orientating antenna device may comprise an outer case disposed outside the inner case side part, wherein the outer case has a plurality of slots formed thereon. Or, the auto orientating antenna device may comprise an outer case disposed outside the inner case side part, wherein the outer case is a spiral structure. Or, the auto orientating antenna device may comprise a removable outer case disposed outside the inner case side part.

In an embodiment, the signal receiving status is defined as the strength (typically, the amplitude) of a signal received by the antenna unit in a receiving direction.

Furthermore, the processor can calculate the strengths of the signals received by the antenna unit in different receiving directions, and find a receiving direction corresponding to the maximum strength of the signal, and the motor can rotate the rotating shaft to let the antenna unit face the receiving direction corresponding to maximum strength of the signal. Or, the processing chip can calculate the strength of the signal received by the antenna unit in at least one receiving direction, and find a receiving direction corresponding to the strength of the signal greater than or equal to a predetermined value, and the motor can drive the rotating shaft to let the antenna unit face the receiving direction corresponding to the strength of the signal greater than or equal to the predetermined value.

In an embodiment, a maximum rotating degree of the rotating shaft is 175 degree in clockwise direction or in counterclockwise direction.

Other objects, advantages, and novel features of the invention will become more apparent from the following detailed description when taken in conjunction with the accompanying drawings.

DETAILED DESCRIPTION OF THE EMBODIMENT

Figure 1:
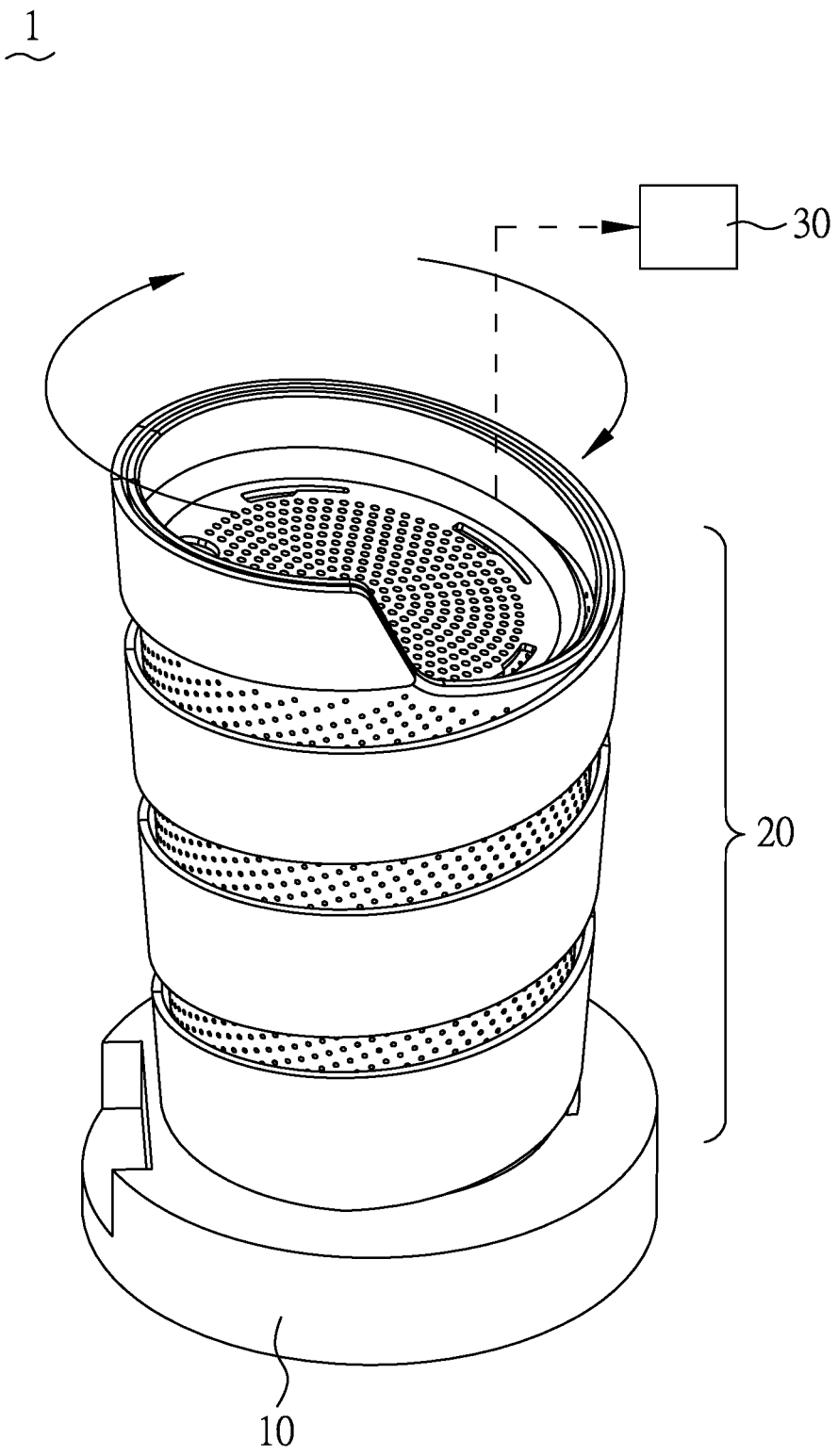
FIG. 1 is a schematic diagram illustrating an auto orientating antenna device according to an embodiment of the present disclosure.

Different embodiments of the present disclosure are provided in the following description. These embodiments are meant to explain the technical content of the present disclosure, but not meant to limit the scope of the present disclosure. A feature described in an embodiment may be applied to other embodiments by suitable modification, substitution, combination, or separation.

It should be noted that, in the present specification, when a component is described to have an element, it means that the component may have one or more of the elements, and it does not mean that the component has only one of the element, except otherwise specified.

Moreover, in the present specification, the ordinal numbers, such as "first" or "second", are used to distinguish a plurality of elements having the same name, and it does not means that there is substantially a level, a rank, an executing order, or an manufacturing order among the elements, except otherwise specified. A "first" element and a "second" element may exist together in the same component, or alternatively, they may exist in different components, respectively. The existence of an element described by a greater ordinal number does not substantially means the existent of another element described by a smaller ordinal number.

Moreover, in the present specification, the terms, such as "top", "bottom", "left", "right", "front", "back", or "middle", as well as the terms, such as "on", "above", "under", "below", or "between", are used to describe the relative positions among a plurality of elements, and the described relative positions may be interpreted to include their translation, rotation, or reflection.

Moreover, in the present specification, when an element is described to be arranged "on" another element, it does not substantially means that the elements contact the other element, except otherwise specified. Such interpretation is applied to other cases similar to the case of "on".

Moreover, in the present specification, the terms, such as "preferably" or "advantageously", are used to describe an optional or additional element or feature, and in other words, the element or the feature is not an essential element, and may be ignored in some embodiments.

Moreover, each component may be realized as a single circuit or an integrated circuit in suitable ways, and may include one or more active elements, such as transistors or logic gates, or one or more passive elements, such as resistors, capacitors, or inductors, but not limited thereto. Each component may be connected to each other in suitable ways, for example, by using one or more traces to form series connection or parallel connection, especially to satisfy the requirements of input terminal and output terminal. Furthermore, each component may allow transmitting or receiving input signals or output signals in sequence or in parallel. The aforementioned configurations may be realized depending on practical applications.

Moreover, in the present specification, the terms, such as "system", "apparatus", "device", "module", or "unit", refer to an electronic element, or a digital circuit, an analogous circuit, or other general circuit, composed of a plurality of electronic elements, and there is not substantially a level or a rank among the aforementioned terms, except otherwise specified.

Moreover, in the present specification, two elements may be electrically connected to each other directly or indirectly, except otherwise specified. In an indirect connection, one or more elements, such as resistors, capacitors, or inductors may exist between the two elements. The electrical connection is used to send one or more signals, such as DC or AC currents or voltages, depending on practical applications.

It is noted that, the description "when . . . " may include "concurrent to", "before", or "after".

Besides, technical effects associated with a feature means that the feature may provide any, some, or all of these technical effects.

Moreover, in the present disclosure, a particular operation executed by an element means that the element may not only execute the particular operation, but also other operations.

For the convenience of explanation, the direction mentioned in the present specification is defined when an object is placed on a horizontal plane (such as a table). In this way, a bottom of the object means a part of the object near the table, and a top of the object means a part of the object far away from the table, and so on.

Figure 2:
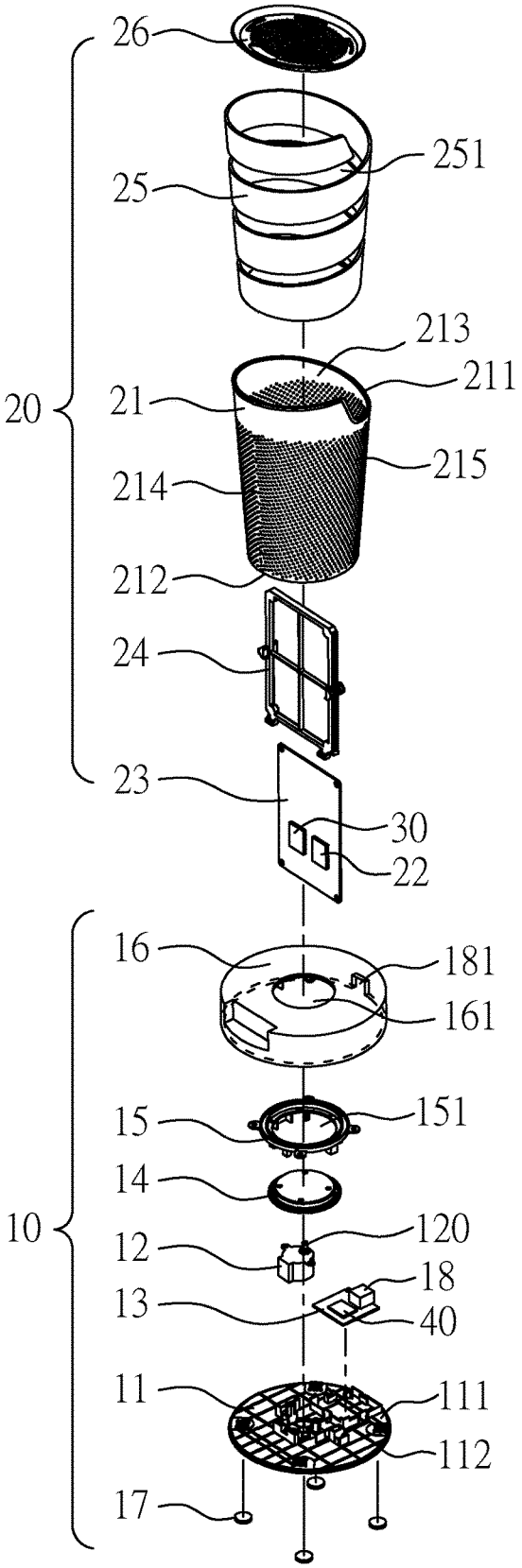
FIG. 2 is an exploded view illustrating the auto orientating antenna device according to an embodiment of the present disclosure.

FIG. 1 is a schematic diagram illustrating an auto orientating antenna device 1 according to an embodiment of the present disclosure, and FIG. 2 is an exploded view illustrating the auto orientating antenna device 1 according to an embodiment of the present disclosure. As shown in FIGS. 1 and 2, the auto orientating antenna device 1 comprises a base 10, a body 20, and a processing chip 30.

The base 10 comprises a motor 12 (as shown in FIG. 2), and the motor 12 comprises a rotating shaft 120. The body 20 is connected to the rotating shaft 120, wherein the connection may be implemented in a way that the body 20 is directly connected to the rotating shaft 120, or the body 20 is indirectly connected to the rotating shaft 120 via an additional unit. The details of "the body 20 connected to the rotating shat 120" will be described in the embodiments of FIGS. 4(A) and 4(B). Anyway, the body 20 can rotate with respect to the base 10 following the rotation of the rotating shaft 120, and a receiving direction of the antenna unit 22 can be adjusted through the rotation of the body 20. Typically, the body 20 rotates with respect to the base 10 when the base 10 is fixed on the table, but not limited thereto.

The body 20 comprises at least one antenna unit 22, wherein the antenna unit 22 is 5G (5th generation mobile network) antenna unit. In another embodiment, the body 20 may comprise a plurality of antenna units 22.

The processing chip 30 is used to generate an auto orientating instruction S1 according to at least one signal receiving status of the antenna unit 22. The motor 12 can drive the rotating shaft 120, so that the rotating shaft 120 can rotate, and the body 20 can be rotated following the rotating shaft 120, or the motor 12 can stop the rotating shaft 120 from a rotating status. Thus, the body 20 can rotate with respect to the base 10 or stop rotating from the rotating status, and the antenna unit can face a suitable receiving direction. It is noted that, "the signal receiving status" may be defined as the strength of a 5G signal. Besides, the term "signal receiving" may refer to "signal transmitting" or "signal recreating".

Then, the details of each elements of the present disclosure will be described as follows.

Regarding the base 10, the base 10 may comprise a bottom cover 11, the motor 12, a control circuit board 13, a motor top 14, a bottom holder 15, a bottom case 16, at least one rubber foot 17, and an input/output interface 18. Besides, a controlling chip 40 may be disposed on the control circuit board 13.

Regarding the bottom cover 11, in an embodiment, the bottom cover 11 has an upper surface 111 and a lower surface 112 opposite to the upper surface 111, wherein the lower surface 112 is near to the table. The motor 12 and the control circuit board 13 may be disposed on the upper surface 111. The rubber foot 17 may be disposed on the lower surface 112 and contact the table, so that the friction between the base 10 and the table can be enhanced.

Regarding the motor 12, in an embodiment, the rotating shaft 120 extends toward a direction away from the bottom cover 11, and the rotating shaft 120 may be fixed to the motor top 14. Any fixing method may be applied as long as it is reasonable. Accordingly, when the rotating shaft 120 rotates, the motor top 14 also rotates following the rotation of the rotating shaft 120. Besides, in an embodiment, the rotating shaft 120 or the motor top 14 may be equipped with a bearing structure to smoothen the rotation.

Regarding the motor top 14, the bottom holder 15 and the bottom case 16, in an embodiment, the bottom holder 15 may be fixed to an inner side of the bottom case 16 and the upper surface 111 of the bottom cover 11 (by any reasonable fixing method), so that the bottom case 16 is combined with the bottom cover 11. The bottom holder 15 may comprise a contain part 151 to contain the motor top 14. The bottom case 16 may have an opening 161 formed thereon, and the opening 161 corresponds to the position of the motor top 14, so that at least one part of the motor top 14 is exposed from the opening 161.

Regarding the controlling chip 40, in an embodiment, the controlling chip 40 may be electrically connected to the motor 12 to control the motor 12 to drive the rotating shaft 120. It is noted that, an "electrical connection" in the present specification may be regarded as a "direct connection", an "indirect connection", or a "wireless signal transmission", but not limited thereto. In an embodiment, the controlling chip 40 may receive an instruction from the processing chip 30, or transmit a signal to the processing chip 30.

It is noted that, the controlling chip 40 may comprise a plurality of circuits, such as a memory circuit, a signal processing circuit, a signal converting circuit, or a communication circuit, but not limited thereto.

Regarding the input/output interface 18, the input/output interface 18 may be disposed on the upper surface 111 of the bottom cover 11. In an embodiment, the position of the input/output interface 18 may correspond to a second opening 181 formed on the bottom case 16, so that when the bottom case 16 is combined with the bottom cover 11, the input/output interface 18 is exposed form the second opening 181. In an embodiment, the input/output interface 18 may be electrically connected to the controlling chip 40 or the processing chip 30, but not limited thereto. In an embodiment, the input/output interface 18 may comprise a power interface or a data transmission interface (e.g. a universal serial bus (USB) interface or LAN interface), but not limited thereto.

Then, regarding the body 20, the body 20 may comprise an inner case 21, the antenna unit 22, a circuit board 23, a circuit board holder 24, an outer case 25, and a top 26. The antenna unit 22 and the processing chip 30 may be disposed on the circuit board 23 or electrically connected to the circuit board 23.

Regarding the circuit board 23 and the circuit board holder 24, in an embodiment, the circuit board holder 24 is fixed to the inner case 21, and the circuit board 23 is fixed to the circuit board holder 24, so the inner case 21 can protect the circuit board 23.

Regarding the inner case 21, in an embodiment, the inner case 21 has a top terminal 211, a bottom terminal 212, and an inner case side part 214 connected to the top terminal 211 and the bottom terminal 212, wherein when the body 20 is combined with the base 10, the top terminal 211 is located far away from the base 10, while the bottom terminal 212 is located near the base 10. The top terminal 211 may comprise an inner case opening 213 used to contain the top 26. In an embodiment, the bottom terminal 212 may be connected to the motor top 14, so that when the rotating shaft 120 rotates, the motor top 14 and the body 20 also rotate.

Besides, the inner case 21 may be a hollow structure of various shapes, such as a circular cylinder and an elliptical cylinder, but not limited thereto. In an embodiment, in a top view (e.g. observed from the top 26 toward the base 10), the size of the top terminal 211 and the size of the bottom terminal 212 are different, so the inner case 21 presents as a trapezoidal cylinder (as shown in FIG. 1), but in another embodiment, the size of the top terminal 211 and that of the bottom terminal 212 are the same. In addition, in an embodiment, in a side view, the top terminal 211 is not parallel to the bottom terminal 212. For example, when the bottom terminal 212 is placed on the table, the top terminal 211 has a slope with respect to the bottom terminal 212. Therefore, when the top 26 is contained in the inner case opening 213, the top 26 is not parallel to the bottom terminal 212 as well.

Besides, in an embodiment, the inner case side part 214 may have a plurality of holes 215 formed thereon. The holes 215 can help heat dissipation for the components in the inner case 21. In an embodiment, the top 26 may have a plurality of holes formed thereon to enhance the effect of the heat dissipation.

Regarding the outer case 25, in an embodiment, the outer case 25 may be disposed outside the inner case side part 214, e.g. the outer case 25 encases the inner case side part 214, so that at least one part of the inner case side part 214 is covered by the outer case 25. In an embodiment, the outer case 25 may be fixed on the inner case side part 214, and in this case, the outer case 25 directly contacts the inner case side part 214. In an embodiment, the outer case 25 may be fixed on the base 10, and there remains a distance between the outer case 25 and the inner case side part 214. Besides, in an embodiment, the outer case 25 may has at least one slot 251 formed thereon, but not limited thereto.

Regarding the antenna unit 22, in an embodiment, the antenna unit 22 is at least one 5G millimeter wave (mm-Wave) antenna, and the antenna unit 22 has a working band more than 24 GHz, but in another embodiment, the antenna unit 22 may be a sub 6 GHz antenna with a working band lower than 6 GHz. In an embodiment, the antenna unit 22 may be a single antenna or an antenna array formed by a plurality of antennas. When the antenna unit 22 is the antenna array, the antenna unit 22 can transmit or receive the signal by using beam forming technology.

Regarding the processing chip 30, in an embodiment, the processing chip 30 is electrically connected to the antenna unit 22, so that the processing chip 30 can process the signal received by the antenna unit 22. The processing chip 30 may be electrically connected to the controlling chip 40, so that data can be transmitted between the processing chip 30 and the controlling chip 40. In an embodiment, the processing chip 30 executes an algorithm to enable the auto orientating antenna device 1 to execute an auto orientating procedure. In the auto orientating procedure, the processing chip 30 analyzes the signal receiving status of the antenna unit 22, and determines whether the receiving direction of the antenna unit 22 should be adjusted, and then generates an auto orientating instruction S1, and the controlling chip 40 controls the motor 12 to drive the rotating shaft 120 according to the auto orientating instruction S1. In an embodiment, the term "the signal receiving status" may be defined as the strength of the signal received by the antenna unit 22, but not limit thereto. Besides, in an embodiment, the processing chip 30 may be integrated with the controlling chip 40, and it is still possible to dispose the processing unit 30 outside the body 20. In addition, the processing chip 30 can process data from the input/output interface 18.

It is noted that, the processing chip 30 may comprise a plurality of circuits, such as a memory circuit, a signal processing circuit, a signal converting circuit, or a communication circuit, but not limited thereto.

More details of the present disclosure are described as follows.

Figure 3A:
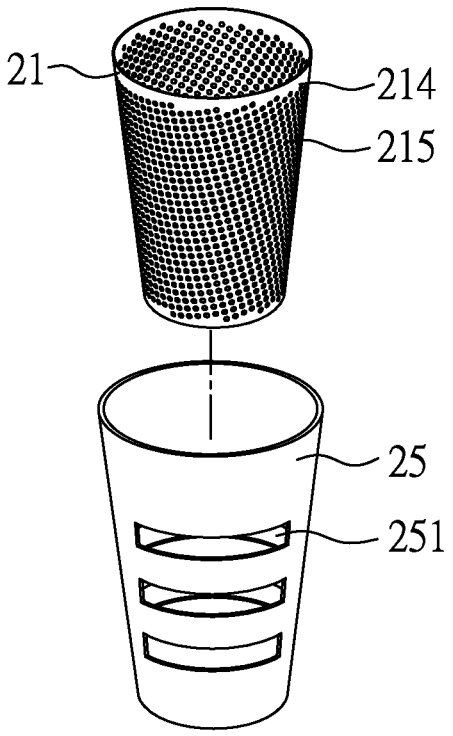
FIG. 3(A) is a schematic diagram illustrating the outer case and the inner case side part according to a first embodiment of the present disclosure.
Figure 3B:
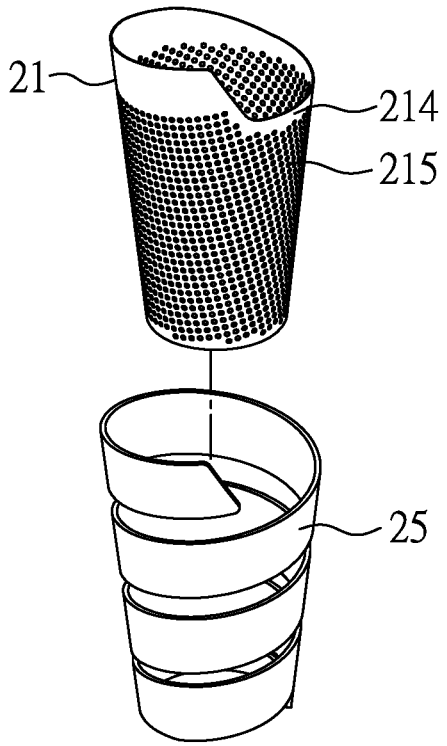
FIG. 3(B) is a schematic diagram illustrating the outer case and the inner case side part according to a second embodiment of the present disclosure.
Figure 3C:
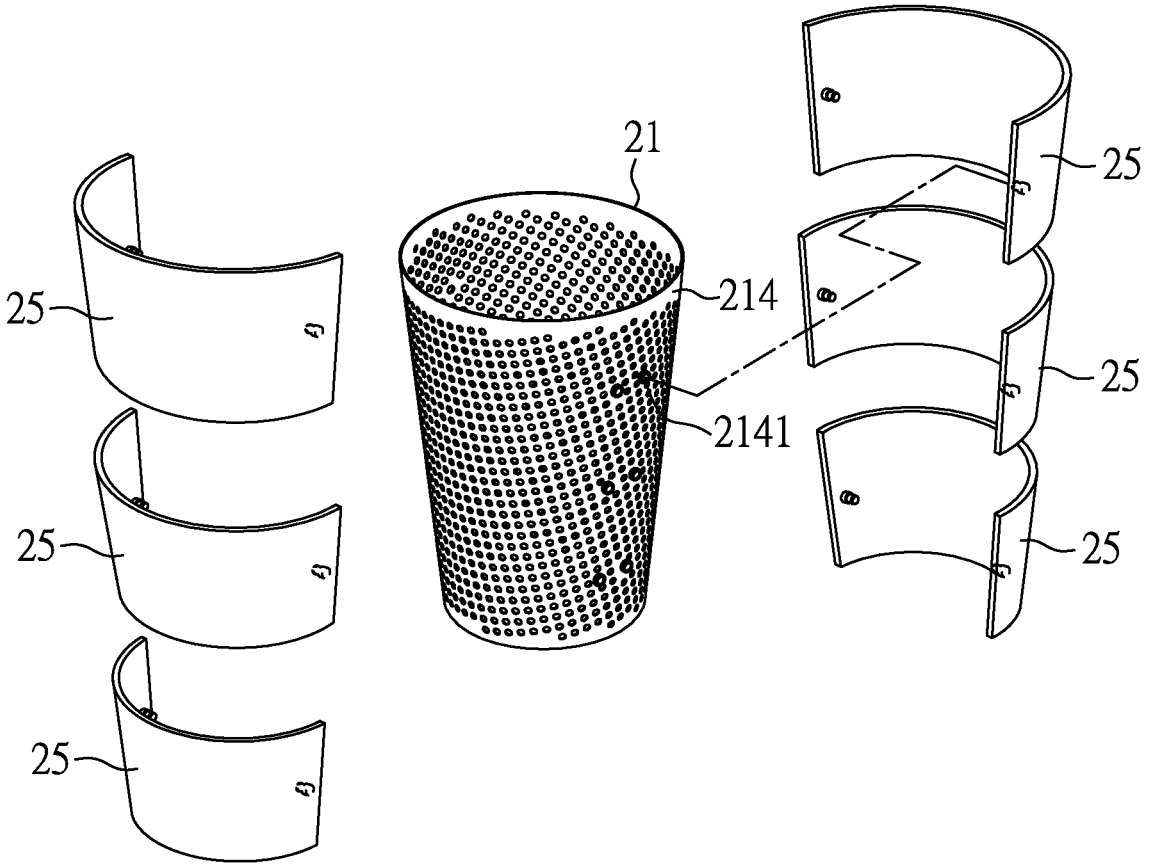
FIG. 3(C) is a schematic diagram illustrating the outer case and the inner case side part according to a third embodiment of the present disclosure.

The outer case 25 and the inner case side part 214 of the present disclosure may be provided with various arrangements. FIG. 3(A) is a schematic diagram illustrating the outer case 25 and the inner case side part 214 according to a first embodiment of the present disclosure, FIG. 3(B) is a schematic diagram illustrating the outer case 25 and the inner case side part 214 according to a second embodiment of the present disclosure, and FIG. 3(C) is a schematic diagram illustrating the outer case 25 and the inner case side part 214 according to a third embodiment of the present disclosure. References to FIG. 3(A), 3(B), or 3(C) may be made with FIGS. 1 and 2, but not limited thereto.

In the first embodiment of FIG. 3(A), the outer case is a hollow cylinder structure. There are slots 251 formed in the outer case 25, and there is no specific limitation set to the shapes, sizes, disposing direction of the slots 251. In an embodiment, the size of a single slot 251 is greater than the size of a single hole 215, so that when the outer case 25 is disposed outside the inner case 21, the single slot 251 corresponds to a plurality of holes 215, e.g. when the outer case 25 is disposed outside the inner case 21, a plurality of holes 215 are exposed from the single slot 251.

In the first embodiment of FIG. 3(B), the outer case is a spiral structure with a spiral slot 251. In an embodiment, when the outer case 25 is disposed outside the inner case 21, the spiral slot 251 corresponds to a plurality of holes 215, e.g. when the outer case 25 is disposed outside the inner case 21, a plurality of holes 215 are exposed from the spiral slot 251.

In the embodiment of FIG. 3(C), the outer case 25 is a removable structure and may be installed on the inner case side part 214. In an embodiment, the outer case 25 and the inner case side part 214 may comprise engaging assemblies 2141, and the outer case 25 may be engaged on or removed from the inner case side part 214 depending on actual requirements. In an embodiment, there are engaging assemblies 2141 disposed on different positions of the inner case side part 214, and the number of the engaging assemblies 2141 on the inner case side part 214 is more than the number of the engaging assemblies 2141 on the outer case 25, so that the outer case 25 can be engaged on different positions of the inner case side part 214 depending on actual requirements.

Figure 4A:
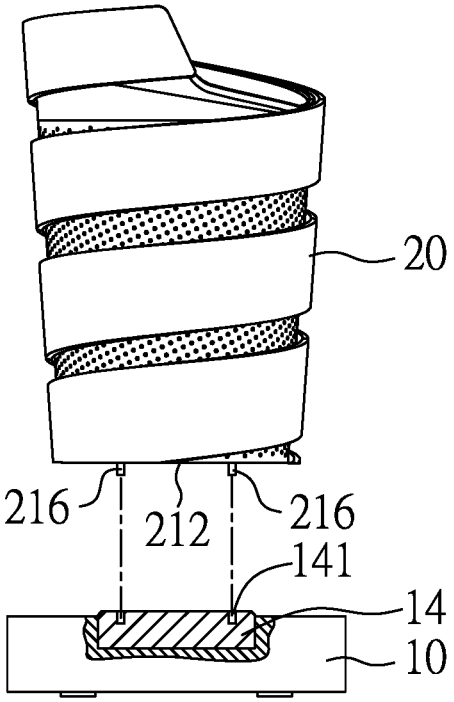
FIG. 4(A) is a schematic diagram illustrating the body and the base according to a first embodiment of the present disclosure.
Figure 4B:
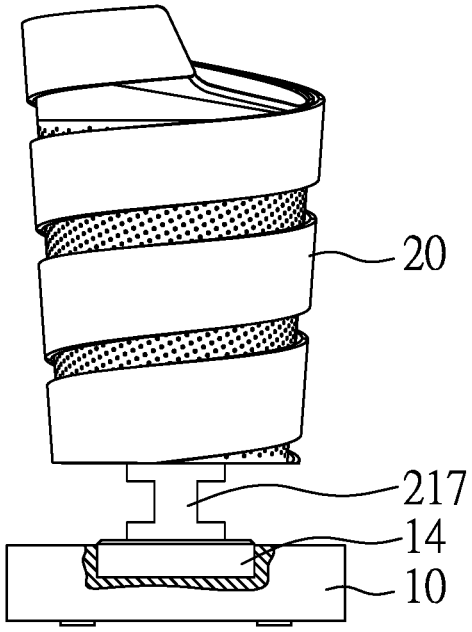
FIG. 4(B) is a schematic diagram illustrating the body and the base according to a second embodiment of the present disclosure.

Besides, the connection between the body 20 and the base 10 may implemented by a plurality types. FIG. 4(A) is a schematic diagram illustrating the body 20 and the base 10 according to a first embodiment of the present disclosure. FIG. 4(B) is a schematic diagram illustrating the body 20 and the base 10 according to a second embodiment of the present disclosure. References to FIG. 4(A) or 4(B) may be made with FIGS. 1 to 3(C), but not limited thereto.

In the embodiment of FIG. 4(A), the body 20 comprises at least one protruding part 216 protruding from the bottom terminal 212 and extending toward the base 10, and the motor top 14 of the base 10 comprises at least one recessing part 141. The size of the recessing part 141 is substantially equal to the size of the protruding part 216, e.g. the size of the recessing part 141 is equal to the size of the protruding part 216 or the size of the recessing part 141 is 1 to 1.05 times greater than the size of the protruding part 216, and the position of the protruding part 216 corresponds to the position of the recessing part 141, so that the protruding part 216 can be engaged with the recessing part 141, and the body 20 can be fixed to the base 10. Besides, in an embodiment, when the protruding part 216 is engaged with the recessing part 141, there remains a distance between the body 20 and the base 10, so as to avoid the friction occurring between the body 20 and the base 10 when the body 20 rotates, wherein the distance may be implemented by forming a part of the motor top 14 that protrudes beyond the base 10, but not limited thereto.

In the embodiment of FIG. 4(B), the bottom terminal 212 of the body 20 is connected to the motor top 14 of the base 10 through a connecting rod 217, wherein a terminal of the connecting rod 217 is fixed to the bottom terminal 212, and another terminal of the connecting rod 217 is fixed to the motor top 14, so that a distance exists between the body 20 and the base 10, and the friction between the body 20 and the base 10 can be avoid when the body 20 rotates.

Figure 5A:
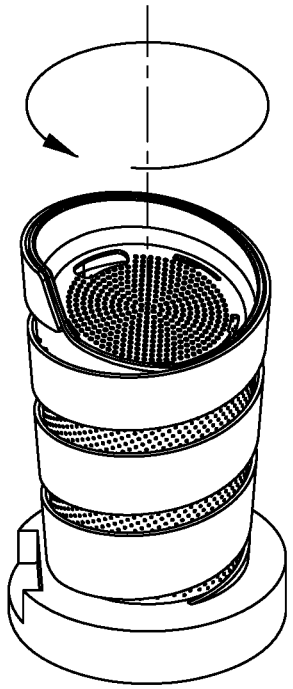
FIG. 5(A) is a schematic diagram illustrating a rotating movement of the auto orientating antenna device according to a first embodiment of the present disclosure.
Figure 5B:
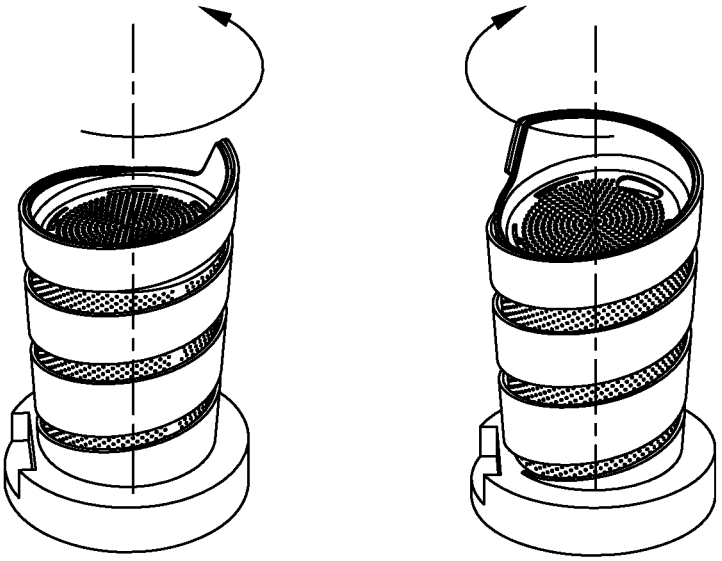
FIG. 5(B) is a schematic diagram illustrating a rotating movement of the auto orientating antenna device according to a second embodiment of the present disclosure.

Then, the rotating types of the auto orientating antenna device 1 are described herein. FIG. 5(A) is a schematic diagram illustrating a rotating movement of the auto orientating antenna device 1 according to a first embodiment of the present disclosure, FIG. 5(B) is a schematic diagram illustrating a rotating movement of the auto orientating antenna device 1 according to a second embodiment of the present disclosure. References to FIG. 5(A) or 5(B) may be made with FIGS. 1 to 4, but limited thereto.

In the embodiment of FIG. 5(A), the body 20 is configured to rotate about "one turn" (or about "one circle") in clockwise direction or in counterclockwise direction. In one embodiment, the term "one turn" is defined as the rotating angle is 350 degrees (that is, the maximum rotating angle may be 350 degree) with an error value within 0 to 30 degrees. That is, the maximum rotating angle may be in a range between 320 and 360 degrees, but not limited thereto. Thereby, when the body 20 completes the rotation once, the antenna unit 22 can receive the signal in each receiving direction, and each strength of each signal in each receiving direction can be detected by the processing chip 30.

In the embodiment of FIG. 5(B), the body 20 is configured to rotate an angle in clockwise direction and in counterclockwise direction. In an embodiment, the angle in clockwise direction and the angle in counterclockwise direction may be 175 degree, respectively (that is, the maximum rotating angle may be 175 degree in the respective directions) with an error value within 0 to 30 degrees. That is, the maximum rotating angle may be in a range between 1.45 and 180 degrees in the respective directions, but not limited thereto. Thereby, when the body 20 completes the rotations in clockwise direction and counterclockwise direction once, the antenna unit 22 can receive the signal in each receiving direction, and each strength of each signal in each receiving directions can be detected by the processing chip 30.

By the aforementioned rotation types and an auto orientating procedure executed by the processing chip 30 and the control chip 40, the auto orientating antenna device 1 can automatically face a receiving direction corresponding to better signal strength.

Figure 6A:
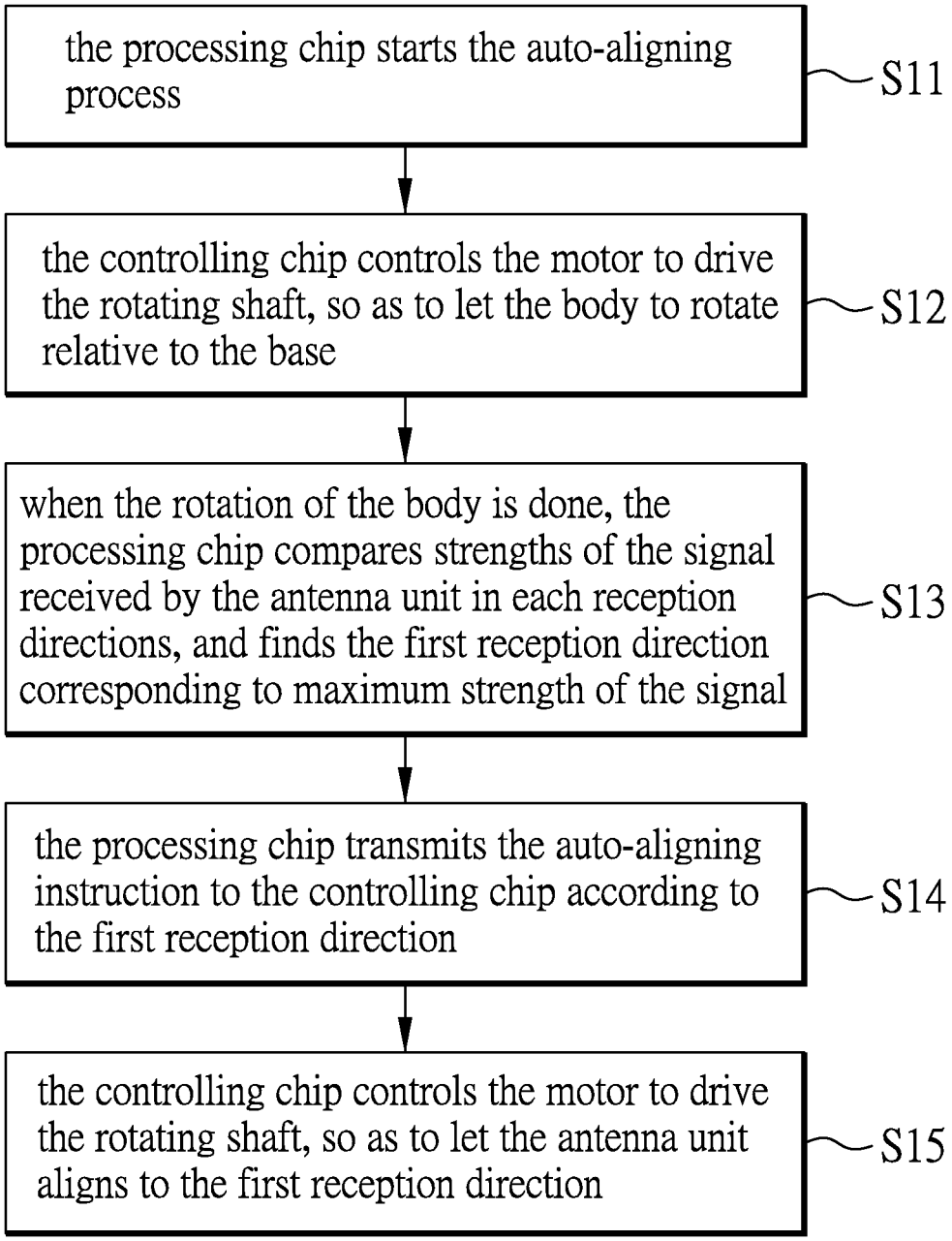
FIG. 6(A) is a flowchart of the steps of the auto orientating procedure according to a first embodiment of the present disclosure.
Figure 6B:
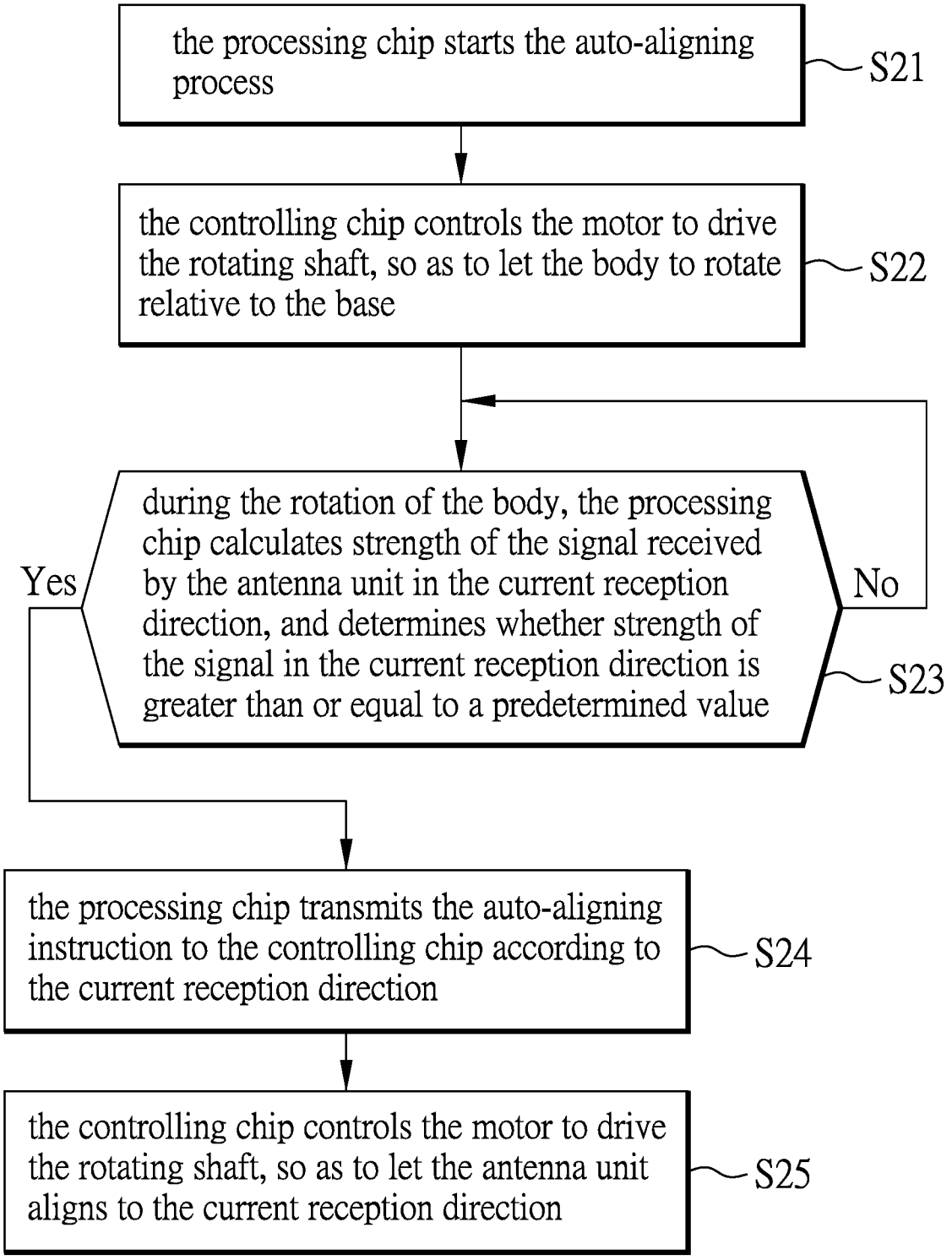
FIG. 6(B) is a flowchart of the steps of the auto orientating procedure according to a second embodiment of the present disclosure.

The details of the auto orientating procedure are described as follows. FIG. 6(A) is a flowchart of the steps of the auto orientating procedure according to a first embodiment of the present disclosure, and FIG. 6(B) is a flowchart of the steps of the auto orientating procedure according to a second embodiment of the present disclosure. References to FIG. 6(A) or 6(B) may be made with FIGS. 1 to 5(B), but not limited thereto.

In the embodiment of FIG. 6(A), the step S11 is executed in a way, that the processing chip 30 starts the auto orientating procedure. The step S12 is executed in a way that the controlling chip 40 controls the motor 12 to drive the rotating shaft 120, so as to let the body 20 to rotate with respect to the base 10, and the antenna unit 22 receives the signals in different receiving directions. The step S13 is executed in a way that when the rotation of the body 20 is done, the processing chip 30 compares the strengths of the signals received by the antenna unit 22 in respective receiving directions, and finds the a receiving direction corresponding to maximum strength of the signal (called a "first receiving direction"). The step S14 is executed in a way that the processing chip 30 transmits the auto orientating instruction S1 to the controlling chip 40 according to the first receiving direction. The step S15 is executed in a way that the controlling chip 40 controls the motor 12 to drive the rotating shaft 120, so as to let the antenna unit 22 to face the first receiving direction. In this way, the auto orientating antenna device 1 can face the receiving direction with maximum signal strength automatically.

Regarding the step S11, in an embodiment, the processing chip 30 can determine whether to start the auto orientating procedure according to a predetermined condition, for example, when the power of the auto orientating antenna device 1 is turned on, or the signal strength of the current receiving direction is lower than a threshold, or the auto orientating procedure is started at specific time point, etc., but not limited thereto.

Regarding the step S12, in an embodiment, when the auto orientating procedure is started, the antenna unit 22 receives the signal in each receiving direction, and transmits the signal receiving status of each receiving direction to the processing chip 30. In an embodiment, an interval between two adjacent receiving directions is in a range between 5 to 10 degrees, but not limited thereto.

Regarding the steps S13, S14, and S15, in an embodiment, when the first receiving direction corresponding to the maximum signal strength is found by the processing chip 30, the processing chip 30 can calculates a distance between a current receiving direction of the antenna unit 22 and the first receiving direction, and then generate the auto orientating instruction S1 according to the distance, which means that, the auto orientating instruction S1 can comprise an information of an angle difference between the current receiving direction and the first receiving direction. In an embodiment, the angle difference may be 0 degree. In this way, the controlling chip 40 can adjust the receiving direction of the antenna unit 22 according to the auto orientating instruction S1.

Accordingly, in the first embodiment of the auto orientating procedure, the auto orientating antenna device 1 can face the direction corresponding to maximum signal strength automatically.

In the embodiment of FIG. 6(B), the step S21 is executed in a way that the processing chip 30 starts the auto orientating procedure. The step S22 is executed in a way that the controlling chip 40 controls the motor 12 to drive the rotating shaft 120, so as to let the body 20 rotate with respect to the base 10, and the antenna unit 12 receives the signal in different receiving directions. The step S23 is executed in a way that during the rotation of the body 20, the processing chip 30 calculates the strength of the signal received by the antenna unit 22 in the current receiving direction, and determines whether the strength of the signal in the current receiving direction is greater than or equal to a predetermined value. When the signal strength in the current receiving direction is not greater than or equal to the predetermined value, the step S23 keeps being executed (i.e. the rotation continues). When the signal strength in the current receiving direction is greater than or equal to the predetermined value, the step S24 is executed, wherein the processing chip 30 transmits the auto orientating instruction S1 to the controlling chip 40 according to the current receiving direction (called a "second receiving direction"). The step S25 is executed in a way that the controlling chip 40 controls the motor 12 to drive or stop the rotating shaft 120, so as to let the antenna unit 22 face the second receiving direction. In this way, the auto orientating antenna device 1 can face the receiving direction with suitable signal strength automatically.

The step S21 may be applied similarly to the description for the step S11, so the detailed description therefor is deemed unnecessary.

Regarding the steps S22 to S25, the processing chip 30 may compare the signal strength in current receiving direction with a predetermined value instantly during the rotation of the body 20. When the signal strength in current receiving direction is greater than or equal to the predetermined value, it means that the signal strength is enough, so the processing chip 30 will transmit the auto orientating instruction S1 to the control chip 40 to stop the operation of the motor 12. In an embodiment, the predetermined value may be adjusted at any time. In an embodiment, if the antenna unit 22 has deviated from the second receiving direction, the auto orientating instruction S1 may comprise a controlling instruction for adjusting the receiving direction of the body 20, which controls the motor 12 to drive the rotation of the rotating shaft 120.

Accordingly, in the second embodiment of the auto orientating procedure, the auto orientating antenna device 1 can face a receiving direction with signal strength satisfying the predetermined value.

In this way, the present disclosure can solve the conventional problem, and the user can place the auto orientating antenna device 1 at any location, and the body 20 of the auto orientating antenna 1 can face a suitable receiving direction automatically.

Although the present disclosure has been explained in relation to its preferred embodiment, it is to be understood that many other possible modifications and variations can be made without departing from the spirit and scope of the invention as hereinafter claimed.

What is claimed is:

1. An auto orientating antenna device, comprising:

a base comprising a motor, wherein the motor comprises a rotating shaft;

a body connected to the rotating shaft and comprising at least one 5G (5th generation mobile network) antenna unit; and a processing chip for generating an auto orientating instruction according to at least one signal receiving status;

wherein the motor drives the rotating shaft according to the auto orientating instruction, so as to let the antenna unit face a receiving direction;

wherein the body comprises an inner case, and the inner case has an inner case side part, and the inner case side part has a plurality of holes formed thereon;

wherein the auto orientating antenna device further comprises an outer case disposed outside the inner case side part, and the outer case has a plurality of slots formed thereon.

2. The auto orientating antenna device as claimed in claim 1, wherein the base comprises at least one input/output interface.

3. The auto orientating antenna device as claimed in claim 1, wherein the signal receiving status is defined as strength of a signal received by the antenna unit in a receiving direction.

4. The auto orientating antenna device as claimed in claim 3, wherein the processing chip calculates the strengths of the signals received by the antenna unit in different receiving directions and determines a receiving direction corresponding to a maximum strength of the signal, and the motor rotates the rotating shaft to let the antenna unit face the receiving direction corresponding to the maximum strength of the signal.

5. The auto orientating antenna device as claimed in claim 3, wherein the processing chip calculates the strength of the signal received by the antenna unit in at least one receiving direction and determines a receiving direction corresponding to strength of the signal greater than or equal to a predetermined value, and the motor rotates the rotating shaft to let the antenna unit face the receiving direction corresponding to the signal strength greater than or equal to the predetermined value.

6. The auto orientating antenna device as claimed in claim 1, wherein the rotating shaft has a maximum rotating angle being 175 degree in clockwise direction or in counterclockwise direction.

7. An auto orientating antenna device, comprising:

a base comprising a motor, wherein the motor comprises a rotating shaft;

a body connected to the rotating shaft and comprising at least one 5G (5th generation mobile network) antenna unit; and a processing chip for generating an auto orientating instruction according to at least one signal receiving status;

wherein the motor drives the rotating shaft according to the auto orientating instruction, so as to let the antenna unit face a receiving direction;

wherein the body comprises an inner case, and the inner case has an inner case side part, and the inner case side part has a plurality of holes formed thereon;

wherein the auto orientating antenna device further comprises an outer case disposed outside the inner case side part, and the outer case is a spiral structure.

8. An auto orientating antenna device, comprising:

a base comprising a motor, wherein the motor comprises a rotating shaft;

a body connected to the rotating shaft and comprising at least one 5G (5th generation mobile network) antenna unit; and a processing chip for generating an auto orientating instruction according to at least one signal receiving status;

wherein the motor drives the rotating shaft according to the auto orientating instruction, so as to let the antenna unit face a receiving direction;

wherein the body comprises an inner case, and the inner case has an inner case side part, and the inner case side part has a plurality of holes formed thereon;

wherein the auto orientating antenna device further comprises at least one removable outer case disposed outside the inner case side part.

* * * * *